US008915186B2

(12) United States Patent
Nadachi et al.

(10) Patent No.: US 8,915,186 B2
(45) Date of Patent: Dec. 23, 2014

(54) METHOD OF AND SYSTEM FOR CLEANING OFF INK IN FLEXOGRAPHIC PRINTING MACHINE

(75) Inventors: Mitsuhiro Nadachi, Mihara (JP); Osamu Hatano, Mihara (JP)

(73) Assignee: Mitsubishi Heavy Industries Printing & Machinery, Ltd., Mihara-Shi, Hiroshima (JP)

( * ) Notice: Subject to any disclaimer, the term of this patent is extended or adjusted under 35 U.S.C. 154(b) by 0 days.

(21) Appl. No.: 13/390,298

(22) PCT Filed: Oct. 28, 2010

(86) PCT No.: PCT/JP2010/069179

§ 371 (c)(1),
(2), (4) Date: Mar. 8, 2012

(87) PCT Pub. No.: WO2011/055679

PCT Pub. Date: May 12, 2011

(65) Prior Publication Data

US 2012/0167791 A1 Jul. 5, 2012

(30) Foreign Application Priority Data

Nov. 5, 2009 (JP) ..... 2009-253820

(51) Int. Cl.
*B41F 35/00* (2006.01)
*B41F 35/04* (2006.01)

(52) U.S. Cl.
CPC ..... *B41F 35/04* (2013.01); *B41P 2235/50* (2013.01)
USPC ..... 101/425; 101/423

(58) Field of Classification Search
CPC ... B41F 35/04; B41P 2235/30; B41P 2235/31
USPC ..... 101/425
See application file for complete search history.

(56) References Cited

U.S. PATENT DOCUMENTS 5,402,724 A * 4/1995 Yaeso et al. ..... 101/424
5,497,702 A * 3/1996 Gorter ..... 101/366

(Continued)

FOREIGN PATENT DOCUMENTS

CN 1122280 A 5/1996
CN 1160639 A 10/1997

(Continued)

OTHER PUBLICATIONS

Japan Patent Office, "Office Action for JP 2009-253820", Jan. 29, 2013.

(Continued)

*Primary Examiner* — Anthony Nguyen
(74) *Attorney, Agent, or Firm* — Benjamin Hauptman; Manabu Kanesaka; Kenneth Berner

(57) ABSTRACT

It is an object is to improve the cleaning effect, to reduce the cleaning time, and to reduce the consumption of cleaning water during cleaning of an inside of an ink chamber of a flexographic printing machine. For cleaning an ink chamber 20, purge air "a" is supplied from pipes 46*a-b* to the ink chamber 20, and an ink "f" is collected from an ink supply pipe 26 and an ink recovery pipe 36 to an ink can 30. Subsequently, cleaning water "w" is supplied from the pipes 46*a-b* to the ink chamber 20, as well as defining a cleaning water circulatory passage 44 constructed from a three-way valve 24, an ink supply port 22, the ink chamber 20, excessive ink recovery ports 32, the ink recovery pipe 36, and a connecting pipe 40 for circulating cleaning water "w" through the circulatory passage 44 to clean inside the ink chamber 20. At the same time, compressed air "a" is supplied from a compressed air supply pipe 424 of an air gun 42 to generate bubbles in the cleaning water "w", thereby improving the cleaning effect on the ink chamber 20 by the agitating action and the turbulent flow generating action of the bubbles.

12 Claims, 9 Drawing Sheets

(56) References Cited

U.S. PATENT DOCUMENTS

| | | | | | |
|---|---|---|---|---|---|
| 5,768,993 | A | * | 6/1998 | Stuart | 101/366 |
| 5,816,163 | A | * | 10/1998 | Achelpohl et al. | 101/483 |
| 5,855,171 | A | * | 1/1999 | McManamon et al. | 101/364 |
| 5,868,858 | A | | 2/1999 | Creed | |
| 5,967,044 | A | * | 10/1999 | Marschke | 101/363 |
| 6,012,391 | A | * | 1/2000 | Weishew | 101/424 |
| 6,165,342 | A | * | 12/2000 | Kuhn et al. | 205/247 |
| 6,576,059 | B2 | * | 6/2003 | Burgard | 118/683 |
| 7,641,448 | B2 | * | 1/2010 | Gydesen | 417/4 |
| 7,677,175 | B2 | * | 3/2010 | Gretsch | 101/483 |
| 7,779,758 | B2 | * | 8/2010 | Wintersgill et al. | 101/350.6 |
| 8,096,237 | B2 | * | 1/2012 | Bitterich et al. | 101/141 |

FOREIGN PATENT DOCUMENTS

| | | | |
|---|---|---|---|
| JP | H08-512250 | | 12/1996 |
| JP | H09201952 | A | 8/1997 |
| JP | H10-157078 | | 6/1998 |
| JP | H10-296961 | | 11/1998 |
| JP | H11-034302 | | 2/1999 |
| JP | 2007-529337 | | 10/2007 |
| JP | 2009-214363 | | 9/2009 |

OTHER PUBLICATIONS

PCT, International Preliminary Report on Patentability, Jun. 21, 2012.

Japan Patent Office, "Office Action for JP 2009-253820", Jul. 2, 2013.

Japan Patent Office, "Decision to Grant a Patent for JP 2009-253820," Mar. 18, 2014.

China Patent Office, "First Office Action for Chinese Patent Application No. 2010800369529", Sep. 30, 2013.

China Patent Office, "Chinese Search Report", Aug. 29, 2013.

China Patent Office, Second Office Action for CN 201080036952.9, Jun. 12, 2014.

* cited by examiner 12
14
16
18
20
22
24
26
32
34
36
41
42
43
44
46a~b
48
a
d
f
m
w 12
14
16
18
20
22
26
32
36
42
45
46a~b
48
50
52
54
f
m
w
a
a+w
424

METHOD OF AND SYSTEM FOR CLEANING OFF INK IN FLEXOGRAPHIC PRINTING MACHINE

RELATED APPLICATIONS

The present application is National Phase of International Application No. PCT/JP2010/069179 filed Oct. 28, 2010, and claims priority from, Japanese Application No. 2009-253820, filed Nov. 5, 2009, the disclosure of which is hereby incorporated by reference herein in its entirety.

TECHNICAL FIELD

The present invention relates a method of and a system for cleaning off an ink in a flexographic printing machine provided in a corrugated board box producing line, which improves the cleaning effect, reduces the time required for cleaning, as well as reducing the consumption of cleaning water, during ink cleaning.

BACKGROUND ART

A box producing apparatus line for producing corrugated board sheet boxes from corrugated board sheets is provided with a paper supply section, a flexographic printing section, a slotting section for forming scorer lines, flaps, and joints, a perforating section, a folding section, and a joint bonding section, in this order, from the upstream.

Among them, the flexographic printing section performs printing on corrugated board sheets with flexographic inks using a flexographic printing machine.

As used herein, "flexographic printing" is one type of letter press printing techniques. Flexographic printing is a printing technique using printing blocks, made from rubber or synthetics resins, and liquid inks (water-soluble inks and UV inks), and has been employed for surface printing on corrugated board sheets, films, and textiles. Recently, improvements in the laser engraving and printing techniques enable more-precise printing, and new demands for the flexographic printing is being created.

Patent Reference 1 (Japanese Laid-Open Patent Application H10-296961) discloses a procedure for changing inks in a flexographic printing machine. Hereinafter, a flexographic printing machine and a procedure for changing inks in this flexographic printing machine, disclosed in Patent Reference 1, will be described with reference to FIGS. 11 and 12.

In FIGS. 11 and 12, a flexographic printing machine 100 includes an ink supply device 102, an anilox roll 104, a printing die 106, a printing cylinder 108, and an impression cylinder (receiving roll) 110, for printing on a corrugated board sheet "c".

The printing die 106 is wound about the outer peripheral face of the printing cylinder 108, and a flexographic ink (hereinafter, simply referred to as an ink) "f" is supplied from the ink supply device 102 to the outer peripheral face of the anilox roll 104. The anilox roll 104 rotates while contacting the printing die 106 to transfer the ink "f" to the surface of the printing die 106. The impression cylinder 110 is provided under the printing cylinder 108 so as to face the printing cylinder 108. The corrugated board sheet "c" is inserted between the printing cylinder 108 and the impression cylinder 110 by means of rotations of the printing cylinder 108 and the impression cylinder 110, and the printing die 106 prints on the corrugated board sheet "c".

The ink supply device 102 is provided with an ink chamber 112 which is enclosed with a chamber frame 114 that defines the rear wall and the left and right walls, a seal blade 116 provided at the upper end of the chamber frame 114, a doctor blade 118 provided at the lower end of the chamber frame 114, and the anilox roll 104 that rotates while contacting the blades 116 and 118. The ink chamber 112 is formed along the long axis direction of the anilox roll 104 such that an ink "f" stored in the ink chamber 112 contacts the outer peripheral face of the anilox roll 104.

Multiple (four, in FIG. 11) air supply ports 120 are provided along the longitudinal direction of the chamber frame 114 at the top of the chamber frame 114. An air supply branch pipe 124 branched from an air supply pipe 122 is connected to each air supply port 120. In the air supply pipe 122, a solenoid valve 126 is interposed, and a compressed air supply device (not shown), such as a compressor, for supplying compressed air "a", is connected.

Furthermore, an ink supply port 128 is formed at the bottom of the center with respect to the longitudinal direction of the chamber frame 114, and an ink supply pipe 130 is connected to the ink supply port 128. An ink pump 132 and a solenoid valve 134 are interposed in the ink supply pipe 130, and the ink supply pipe 130 is connected to an ink container 136.

An ink recovery system for recovering the ink "f" in the ink chamber 112 to the ink container 136 is constructed from ink recovery pipes 142 connected to ink recovery ports 138 formed at the bottom ends of the chamber frame 114; excessive ink recovery pipes 144 connected to the excessive ink recovery ports 140 (for maintaining constant ink fluid level) formed at the upper ends of the chamber frame 114; solenoid valves 146 interposed in the ink recovery pipes 142; and an ink recovery pipe 148 connecting between the ink recovery pipes 142 and the excessive ink recovery pipes 144, and the ink container 136.

A cleaning water supply pipe 152 is connected to the ink supply pipe 130 between the solenoid valve 134 and the ink pump 132, via a solenoid valve 150.

In this configuration, during normal printing operations, the ink pump 132 is operated with the solenoid valve 150 being closed and the solenoid valve 134 being opened, to supply the ink "f" from the ink container 136 through the ink supply port 128 into the ink chamber 112. At this time, the solenoid valves 146 are closed, and the ink "f" is maintained to a certain ink fluid level in the ink chamber 112, since any excessive ink overflows from the excessive ink recovery ports 140.

For changing inks, the ink pump 132 is operated in the reverse direction to recover the ink "f" in the ink chamber 112 from the ink supply port 128, as well as opening the solenoid valves 146. Subsequently, the solenoid valve 126 is opened to supply the compressed air "a" from the air supply pipe 122 into the ink chamber 112, thereby pressurizing the ink chamber 112. As a result, the ink "f" in the ink chamber 112 is forcefully collected from the ink supply pipe 130 and the ink recovery pipe 148 to the ink container 136. After a predetermined time duration, the solenoid valve 126 is closed to stop the supply of the compressed air "a".

For ink cleaning, the ink container 136 is replaced with a waste fluid pit (not shown), and the solenoid valves 134 and 146 are closed. Subsequently, the solenoid valve 150 is opened, as well as operating the ink pump 132 in the forward direction, to supply cleaning water "w" from the cleaning water supply pipe 152. The cleaning water "w" is supplied into the ink chamber 112 via the same path during the circulation of the ink "f", and the ink chamber 112 is filled with the cleaning water "w". The cleaning water "w" is then collected from the excessive ink recovery ports 140 to the waste fluid pit, through the ink recovery pipe 148. This operation is repeated for a predetermined time duration to clean inside the ink circulation path.

For collecting the cleaning water, the solenoid valve 150 is closed to stop the supply of the cleaning water "w", and the solenoid valves 134 and 146 are opened. Subsequently, the ink pump 132 is operated in the reverse direction and the solenoid valve 126 is opened to supply the compressed air "a" from the air supply pipe 122 into the ink chamber 112. As a result, the cleaning water "w" in the ink chamber 112 is drained out of the ink chamber 112 from the ink supply port 128 and the ink recovery ports 138, under the pressure by the compressed air "a", and is forcefully collected into the waste fluid pit.

Subsequently, the ink supply pipe 130 and the ink recovery pipe 148 are connected to an ink container 136 for a subsequent order. An subsequent order ink "f" is supplied to the ink chamber 112 through the ink supply pipe 130, for commencing printing of the subsequent order.

PRIOR ART REFERENCE

Patent Document

Patent Reference 1: Japanese Laid-Open Patent Application No. H10-296961

DISCLOSURE OF THE INVENTION

Problems to be Solved by the Invention

In the method for changing inks disclosed in Patent Reference 1, after supplying cleaning water "w" to the ink chamber 112 through the cleaning water supply pipe 152, the inside of the ink chamber 112 is cleaned, while collecting the cleaning water "w" through the ink supply pipe 130 and the ink recovery pipe 148. Thus, cleaning water "w" is drained after the cleaning water "w" is flowed through the ink chamber 112 once. Accordingly, there are issues of a lower cleaning effect relative to the consumption of the cleaning water, as well as a longer cleaning time and an increased consumption of the cleaning water "w".

In light of the issues of the above-described related art, an object of the present invention is to reduce the cleaning time and to reduce the consumption of cleaning water, by improving the cleaning effect during cleaning of an inside of the ink chamber of a flexographic printing machine. Furthermore, it is also an object to reduce the ink change time, including a cleaning step.

SUMMARY OF THE INVENTION

To accomplish the above-identified objects, a method of cleaning off an ink in a flexographic printing machine of the present invention is: a method of cleaning off an ink in a flexographic printing machine, wherein a flexographic ink is supplied to an ink chamber facing an outer peripheral face of an anilox roll, and the flexographic ink is transferred from the anilox roll to a printing die wound about a printing cylinder, the method includes: after removing the flexographic ink from the ink chamber, supplying a multiphase fluid to the ink chamber, to clean the ink chamber by means of a cleaning action of the multiphase fluid.

In the method of the present invention, the multiphase fluid is formed by mixing a gas or minute granular solids in two or more liquids or a liquid, in which the cleaning action is provided by suitably selecting the components to be mixed. For example, the multiphase fluid is a cleaning liquid of water mixed with a cleaning agent, water or a cleaning liquid mixed with bubbles, or any other mixtures of two or more liquids or gases having the cleaning action.

When water containing bubbles or a cleaning liquid is supplied into the ink chamber, the cleaning effect on the inside of the ink chamber is further enhanced by the agitating action and the turbulent flow generation action of the cleaning liquid containing the bubbles.

Since the cleaning effect on the outer peripheral face of the anilox roll and the inside of the ink chamber can be enhanced by means of the multiphase fluid, the cleaning time can be reduced and the consumption of the multiphase fluid can also be reduced.

In the method of the present invention, a circulation line for the multiphase fluid may be connected to the ink chamber to supply the multiphase fluid to the ink chamber through the circulation line in a circulatory manner.

By supplying the multiphase fluid to the ink chamber in a circulatory manner, the cleaning effect can be further improved and the consumption of the multiphase fluid can also be further reduced, since the multiphase fluid is cycled in a circulatory manner.

Experimental results by the present inventors et al. found that the cleaning effect on the inside of the ink chamber can be improved by providing a one-directional flow of a multiphase fluid in the longitudinal direction in the ink chamber. In the method of the present invention, a one-directional flow (either the direction from the driven side to the operating side, or the direction from the operating side to the driven side) of the multiphase fluid may be generated in a longitudinal direction of the ink chamber inside the ink chamber.

The experimental results by the present inventors et al. also found that a pressure ratio or a flow rate ratio between each fluid contained in the multiphase fluid is related to the cleaning effect. Therefore, a pressure ratio or a flow rate ratio between each fluid contained in the multiphase fluid may be controlled to improve an cleaning effect on the inside of the ink chamber.

Furthermore, a system for cleaning off an ink in a flexographic printing machine of the present invention which can be directly used for the above-described method of the present invention, is: a system for cleaning off an ink in a flexographic printing machine, wherein a flexographic ink is supplied to an ink chamber facing an outer peripheral face of an anilox roll, and the flexographic ink is transferred from the anilox roll to a printing die wound about a printing cylinder, the system includes: a multiphase fluid supply path that supplies a multiphase fluid to an ink chamber; a multiphase fluid drain path that drains the multiphase fluid out of the ink chamber; and a multiphase fluid generator that supplies the multiphase fluid to the multiphase fluid supply path, wherein the system is configured to supply the multiphase fluid to the ink chamber to clean an inside of the ink chamber by means of a cleaning action of the multiphase fluid.

Since the outer peripheral face of the anilox roll and the inside of the ink chamber can be cleaned with the multiphase fluid in the above-described configuration, the cleaning effect on the inside of the ink chamber can be improved with the cleaning action of the multiphase fluid. As a result, the cleaning time can be reduced and the consumption of the multiphase fluid can also be reduced.

In the system of the present invention, a supply circulatory passage may be connected to the multiphase fluid supply path and the multiphase fluid drain path, for supply the multiphase fluid to the ink chamber in a circulatory manner. Since this allows the multiphase fluid to be supplied into the ink chamber in a circulatory manner, the cleaning effect on the inside of the ink chamber can be further improved and the consumption of the multiphase fluid can be further reduced.

In the system of the present invention, if the multiphase fluid is a cleaning liquid containing bubbles, a multiphase fluid generator may generate the cleaning liquid containing the bubbles at the multiphase fluid supply path by supplying the air to the cleaning liquid flowing through the multiphase fluid supply path.

For example, the multiphase fluid generator may be an air gun that forcefully injects the air into the multiphase fluid supply path or a device for taking the air into the multiphase fluid supply path by means of an ejector action. The air is taken into the cleaning liquid by employing the air suctioning action of the air gun or the ejector action, and the cleaning liquid containing bubbles is supplied to the ink chamber.

By employing the air suctioning action of the air gun or the ejector action, the cleaning effect on the inside of the ink chamber can be enhanced by means of the agitating action and the turbulent flow generation action of the cleaning liquid containing bubbles and the energy of the high velocity flow of the cleaning liquid. Furthermore, injection of the bubbles into the cleaning liquid and the supply of the cleaning liquid to the ink chamber can be achieved only by a device utilizing an air gun or the ejector action, which can simplify the structure of the system and reduce the cost.

In the system of the present invention, a device for generating a pressure difference between two ends of the ink chamber in a longitudinal direction of the ink chamber may be provided, to generate a one-directional flow of the multiphase fluid in the longitudinal direction of the ink chamber by generating a pressure difference between the two ends of the ink chamber in the longitudinal direction. As described above, by generating the pressure difference between the ends of the longitudinal direction of the ink chamber to generate a one-directional flow of the multiphase fluid in the longitudinal direction of the ink chamber, the cleaning effect on the inside of the ink chamber can be improved. The greater the pressure difference is, the higher the flow velocity of the multiphase fluid becomes, which further enhances the cleaning effect.

The device may be an air gun provided at least one of upstream and downstream multiphase fluid supply paths with respect to the ink chamber. The air gun provided at the multiphase fluid supply path enables both the injection of bubbles into the multiphase fluid and the generation of the pressure difference, with a lower cost. By providing air guns at the upstream and downstream sides to the ink chamber, the pressure gradient can be increased with the combined effect of the discharging action of the bubbles by the air gun provided at the upstream side and the suctioning action by the bubbles by the air gun provided at the downstream side, thereby improving the efficiency of the cleaning.

In the system of the present invention, a pressure reduction device may be provided at the multiphase fluid supply path, to induce a cavitation action in the cleaning liquid to generate bubbles, to supply the cleaning liquid containing bubbles to the ink chamber. This facilitates generation of the bubble-containing cleaning liquid, and the cleaning effect on the inside of the ink chamber can be enhanced by the agitating action resulted from collapse of the bubbles.

Furthermore, in the system of the present invention, a turbulent flow generator may be provided at the multiphase fluid supply path. This generates a turbulent flow in the cleaning water supplied to the ink chamber, thereby enhancing the cleaning effect.

Furthermore, in the system of the present invention, a control panel that displays a pressure ratio or a flow rate ratio between each fluid contained in the multiphase fluid may be provided. This allows the operator to appropriately control the pressure ratio or the flow rate ratio between each fluid contained in the multiphase fluid, while watching the control panel, to improve the cleaning effect on the inside of the ink chamber. The control panel provided to the flexographic printing machine facilitates control of the pressure ratio or the flow rate ratio between each fluid contained in the multiphase fluid.

EFFECT OF THE INVENTION

In accordance with the method of the present invention, a method of cleaning off an ink in a flexographic printing machine, wherein a flexographic ink is supplied to an ink chamber facing an outer peripheral face of an anilox roll, and the flexographic ink is transferred from the anilox roll to a printing die wound about a printing cylinder, the method includes: after removing the flexographic ink from the ink chamber, supplying a multiphase fluid to the ink chamber, to clean the ink chamber by means of a cleaning action of the multiphase fluid. Hence, since the cleaning effect on the outer peripheral face of the anilox roll and the inside of the ink chamber can be enhanced, the cleaning time can be reduced and the consumption of the multiphase fluid can also be reduced.

Furthermore, in accordance with the system of the present invention, the system for cleaning off an ink in a flexographic printing machine, wherein a flexographic ink is supplied to an ink chamber facing an outer peripheral face of an anilox roll, and the flexographic ink is transferred from the anilox roll to a printing die wound about a printing cylinder, the system includes: a multiphase fluid supply path that supplies a multiphase fluid to an ink chamber; a multiphase fluid drain path that drains the multiphase fluid out of the ink chamber; and a multiphase fluid generator that supplies the multiphase fluid to the multiphase fluid supply path, wherein the system is configured to supply the multiphase fluid to the ink chamber to clean an inside of the ink chamber by means of a cleaning action of the multiphase fluid. Hence, the effects similar to those of the above-described method of the present invention can be obtained.

DESCRIPTION OF EMBODIMENTS

Figure 1:
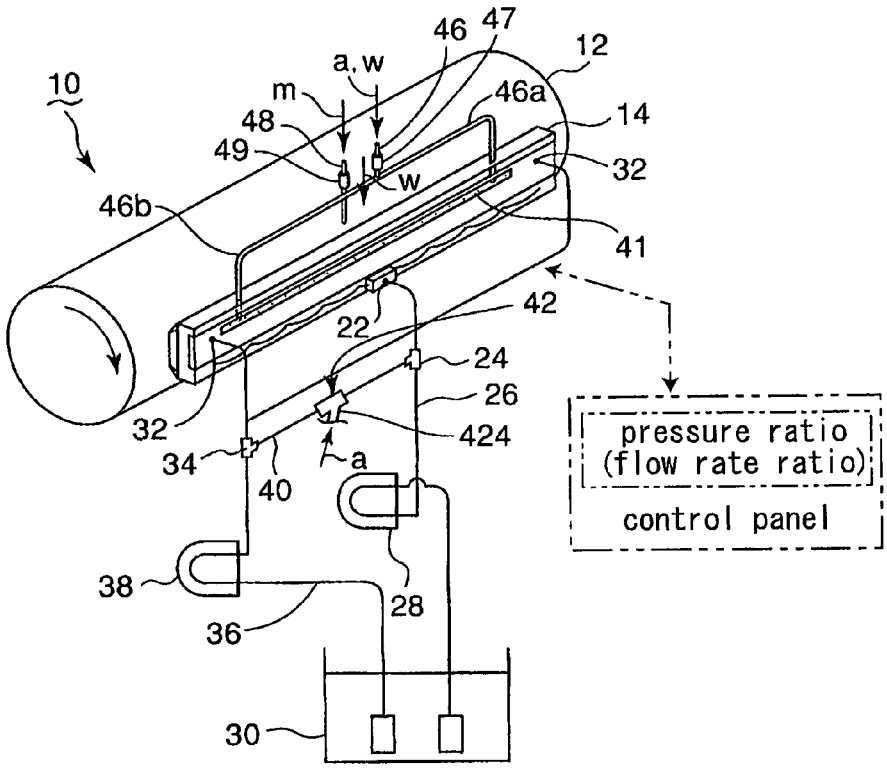
FIG. 1 is a perspective view schematically illustrating a flexographic printing machine according to a first embodiment of a method and a system of the present invention.

Hereinafter, the present invention will be described with reference to embodiments of the present invention shown in the drawings. Unless otherwise stated, it is not intended that the sizes, materials, shapes, relative positions, and the like of components described in the embodiments do not limit the scope of the present invention to these specifics.

First Embodiment

Figure 2:
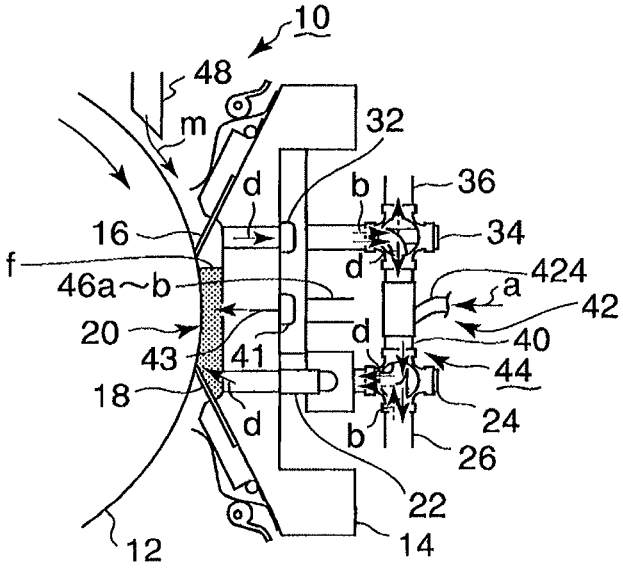
FIG. 2 is a side cross-sectional view schematically illustrating the flexographic printing machine.

A first embodiment of a method and a system of the present invention will be described with reference to FIGS. 1-5. FIGS. 1 and 2 show a portion of a flexographic printing machine 10 of this embodiment. In FIGS. 1 and 2, a chamber frame 14 extends in the long axis direction of an anilox roll 12 so as to face the outer peripheral face of the anilox roll 12. The chamber frame 14 is provided with an ink chamber 20 which is enclosed with a seal blade 16 that forms the rear wall and the left and right walls and is provided at the upper end of the chamber frame 14, a doctor blade 18 provided at the lower end of the chamber frame 14, and the anilox roll 12 that rotates while contacting the blades 16 and 18.

The ink chamber 20 is formed along the axis direction of the anilox roll 12 such that a flexographic ink "f" (hereinafter, referred to as "ink "f") stored in the ink chamber 20 contacts the outer peripheral face of the anilox roll 12. An ink supply port 22 is formed at the bottom of the center with respect to the longitudinal direction of the chamber frame 14, and an ink supply pipe 26 is connected to the ink supply port 22 via a three-way valve 24. An ink supply pump 28 is interposed in the ink supply pipe 26, and an end of the ink supply pump 28 is connected to an ink can 30.

Excessive ink recovery ports 32 are formed at the upper ends of the chamber frame 14, and an ink recovery pipe 36 is connected to the excessive ink recovery port 32 via a three-way valve 34. An ink recovery pump 38 is interposed in the ink recovery pipe 36, and an end of the ink recovery pump 36 is connected to the ink can 30. The ink supply pipe 26 and the ink recovery pipe 36 are coupled to a connecting pipe 40 via the three-way valves 24 and 34, and an air gun 42 is interposed in the connecting pipe 40.

In FIG. 1, the ink supply port 22 is selectively communicative to the ink supply pipe 26 or the connecting pipe 40 by means of the three-way valve 24, and the excessive ink recovery ports 32 are selectively communicative to the ink recovery pipe 36 or the connecting pipe 40 by means of the three-way valve 34.

In this manner, by operating the three-way valves 24 and 34, a circulatory piping line 44 is defined, which circulates through the ink supply pipe 26, the three-way valve 24, the ink supply port 22, the ink chamber 20, the excessive ink recovery ports 32, the three-way valve 34, and the connecting pipe 40.

Furthermore, a pipe 46 for supplying cleaning water "w" or compressed air "a" is also provided, and the pipe 46 is branched into two pipes 46*a* and 46*b*. The pipes 46*a* and 46*b* are respectively connected, near the ends of the chamber frame 14, to a header 41 provided in the longitudinal direction of the chamber frame 14.

Multiple jetting ports 43 (see FIG. 2) are formed in the header 41, through which the cleaning water "w" or the compressed air "a" supplied to the pipe 46 is distributed evenly within the ink chamber 20, along the longitudinal direction of the chamber frame 14. Furthermore, a supply pipe 48, which supplies dampening water "m" to the outer peripheral face of the anilox roll 12, is provided above the seal blade 16. Solenoid valves 47 and 49 are provided at the pipes 46 and 48 for opening or closing the pipes 46 and 48.

Figure 3:
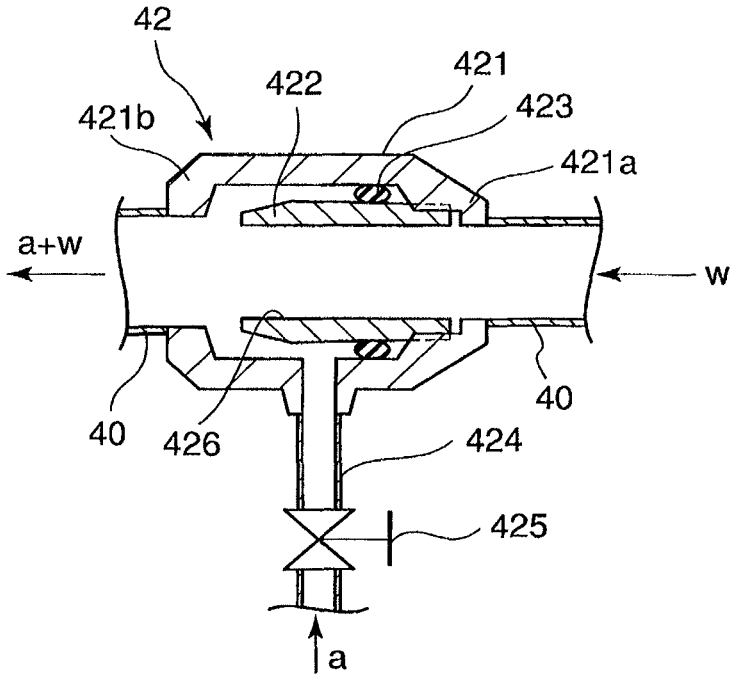
FIG. 3 is a cross-sectional view of an air gun 42 used in the flexographic printing machine.
Figure 4A:
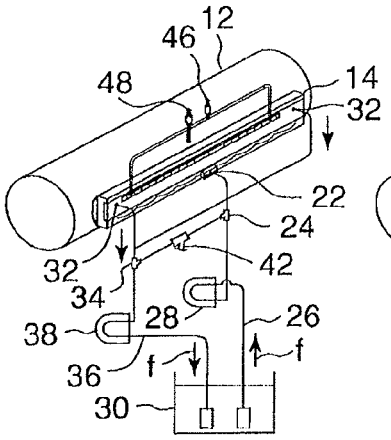
FIGS. 4 (*a*) to 4 (*f*) are perspective views schematically illustrating an ink change procedure in the flexographic printing machine.
Figure 4B:
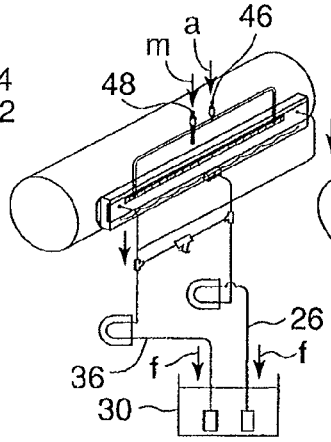
Figure 4C:
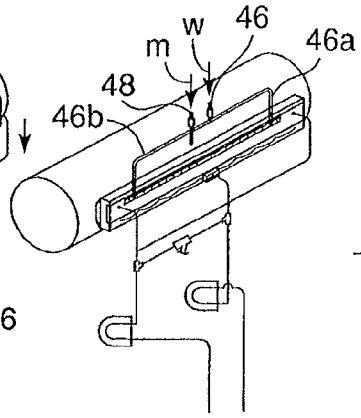
Figure 4D:
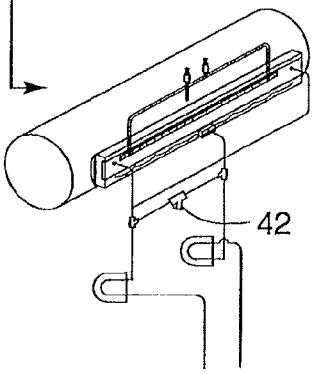
Figure 4E:
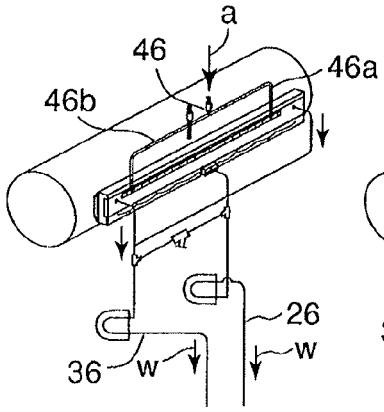
Figure 4F:
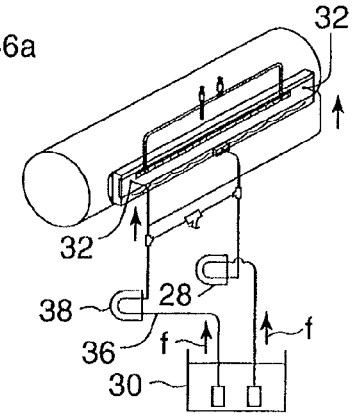

Next, the structure of the air gun 42 will be described with reference to FIG. 3. In FIG. 3, a casing main body 421 of the air gun 42 is interposed in the connecting pipe 40, and includes a suctioning section 421*a* and an ejecting section 421*b*. A cylindrical passage defining member 422 is provided inside the casing main body 421 to define a passage 426 having a circular cross-section within the casing main body 421. An O-ring 423 is provided between the casing main body 421 and the passage defining member 422 for providing sealing. A compressed air supply pipe 424 is connected to the passage 426 via a solenoid valve 425. The compressed air supply pipe 424 is opened or closed by the solenoid valve 425.

When the solenoid valve 425 is opened to open the compressed air supply pipe 424, compressed air "a" flows between the casing main body 421 and the passage defining member 422 and is jetted to the passage 426. The jetting of the compressed air "a" provides the cleaning water "w" with suction force directed from the suctioning section 421*a* toward the ejecting section 421*b*. This results in mixing of the compressed air "a" and the cleaning water "w" inside the passage 426, and the cleaning water containing bubbles (a+w) is jetted from the ejecting section 421*b*.

In this embodiment, the cleaning water "w" may be pure water, or pure water mixed with some sort of a cleaning liquid or a cleaning agent.

Figures 5A, 5B, 5C, 5D, 5E, 5F:
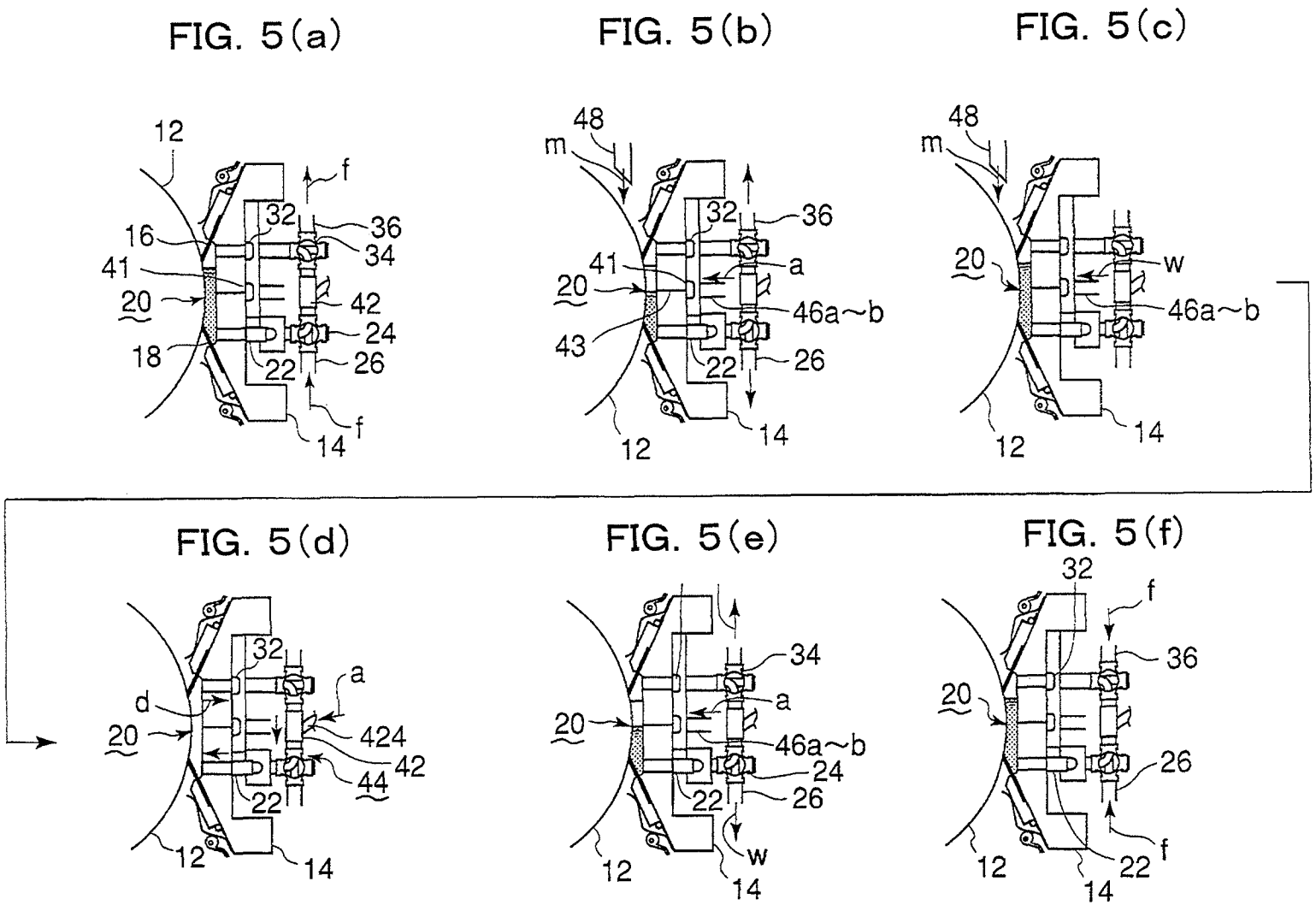
FIGS. 5 (*a*) to 5 (*f*) are side cross-sectional views schematically illustrating an ink change procedure in the flexographic printing machine.

The procedure for changing inks in the above structure will be described with reference to FIGS. 4 and 5. In FIGS. 4 and 5, FIG. 4(*a*) and FIG. 5(*a*) show a printing operation using an ink prior to ink change. In the drawings, the ink supply pump 28 is operated to supply an ink "f" from the ink supply pipe 26 to the ink chamber 20 via the three-way valve 24 and the ink supply port 22. The ink recovery pump 38 is also operated to drain the ink "f" overflowing from the excessive ink recovery ports 32 to the ink recovery pipe 36 via the three-way valve 34. In FIG. 2, the flow of the ink is indicated with the arrow "b", and the flow of bubble-containing cleaning water (a+w), which will be described later, is indicated with the arrow "d".

In FIG. 4(*b*) and FIG. 5(*b*), the printing with the previous order ink is stopped. Dampening water "m" is supplied to the anilox roll 12 from the pipe 48, and purging compressed air "a" is supplied, from the pipes 46*a*-*b* to the header 41, and then to the jetting ports 43, into the ink chamber 20. The compressed air "a" pressurizes inside the ink chamber 20, which results in the ink "f" being collected from the ink supply pipe 26 and the ink recovery pipe 36.

In this step, the ink can be quickly collected by rotating the ink supply pump 28 in the direction reverse to the rotation direction during the ink supply, as well as rotating the ink recovery pump 38 in the same direction as in the ink recovery.

After the previous order ink "f" is being collected, the ink can 30 is rep laced with a waste fluid pit (not shown). Subsequently, as shown in FIG. 4(*c*) and FIG. 5(*c*), cleaning water "w" is supplied to the pipes 46*a-b* while continuing the supply of the dampening water "m" to the pipe 48, to fill the ink chamber 20 with the cleaning water "w".

Subsequently, as shown in FIG. 4(*d*) and FIG. 5(*d*), the three-way valves 24 and 34 are switched to define a circulatory passage 44. Then, compressed air "a" is supplied from the compressed air supply pipe 424 of the air gun 42 into the cleaning water "w", to generate bubbles in the cleaning water "w" and to forcefully circulate the bubble-containing cleaning water (a+w) through the circulatory passage 44 by means of the suctioning action of the compressed air "a". A source for compressed air in a factory may be used for supplying the compressed air "a", and compressed air "a" of 0.6 MPa or below is typically used.

Subsequently, as shown in FIG. 4(*e*) and FIG. 5(*e*), the three-way valves 24 and 34 are switched to connect the ink supply port 22 to the ink supply pipe 26 and to connect the excessive ink recovery ports 32 to the ink recovery pipe 36. Compressed air "a" is then supplied to the pipes 46*a-b* to pressurize inside the ink chamber 20, and the cleaning water "w" in the ink chamber 20 is collected to the waste fluid pit through the ink supply pipe 26 and the ink recovery pipe 36. In other words, the ink supply pipe 26 and the ink recovery pipe 36 define a cleaning water drain path.

In this step, in the manner similar to the ink recovery, the cleaning water "w" can be quickly collected by rotating the ink supply pump 28 in the direction reverse to the rotation direction during the ink supply, as well as rotating the ink recovery pump 38 in the same direction as in the ink recovery.

The cleaning and cleaning water recovery steps from FIG. 4(*c*) to FIG. 4(*e*) are repeated several times, if necessary, with changing cleaning water "w".

Subsequently, as shown in FIG. 4(*f*) and FIG. 5(*f*), the waste fluid pit is replaced with an ink can 30 containing an subsequent order ink, and the ink "f" for the subsequent order is supplied into the ink chamber 20. In this step, by rotating the ink supply pump 28 in the forward direction and rotating the ink recovery pump 38 in the reverse direction, the ink "f" can be supplied to the ink chamber 20 both from the ink supply pipe 26 and from the ink recovery pipe 36. Thereby, the ink supply time can be reduced.

In accordance with this embodiment, during ink cleaning, the circulatory passage 44 that supplies bubble-containing cleaning water (a+w) to the ink chamber 20 in a circulatory manner is defined, and compressed air "a" is supplied from the compressed air supply pipe 424 of the air gun 42. Thus, the bubble-containing cleaning water (a+w) can be circulated to the ink chamber 20. Accordingly, the cleaning effect on the outer peripheral face of the anilox roll 12 and the inside of the ink chamber 20 can be improved by the agitating action and the turbulent flow generation action by the bubbles and a high velocity flow generated by the air gun 42.

Furthermore, by supplying the bubble-containing cleaning water (a+w) to the ink chamber 20 in a circulatory manner and by repeating the circulatory cleaning several times with changing cleaning water "w", if necessary, the cleaning effect can be obtained in a shorter time and the consumption of the cleaning water "w" can be significantly reduced.

Furthermore, by rotating the ink supply pump 28 and the ink recovery pump 38 in the forward or reverse direction during ink supply, ink recovery, or recovery of cleaning water "w", the amount of the ink supplied or recovered and the amount of the cleaning water "w" recovered can be increased, thereby significantly reducing the time required for these operations.

As described above, the total time required for changing inks can be significantly reduced in this embodiment. For example, three minutes required for a conventional ink change procedure can be reduced to about two minutes, and accordingly, the machine stop time for set change is reduced. This can significantly improve the productivity of a box producing apparatus.

Second Embodiment

Next, a second embodiment of a method and a system of the present invention will be described with reference to FIGS. 6-8. In the drawings, components or elements having the same reference numerals as in FIGS. 1-5 have the same structure, and thus the descriptions therefor will be omitted.

Figure 6:
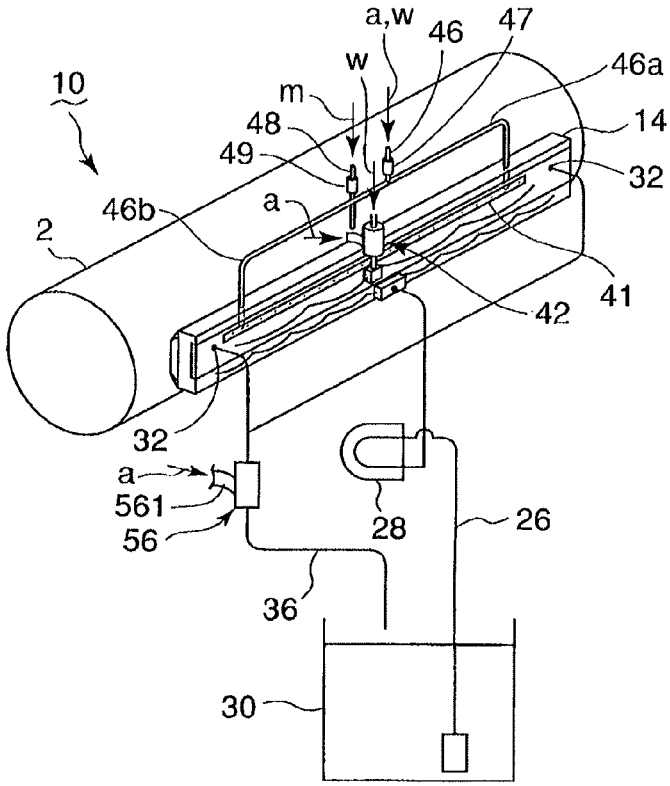
FIG. 6 is a perspective view schematically illustrating a flexographic printing machine according to a second embodiment of a method and a system of the present invention.
Figure 7:
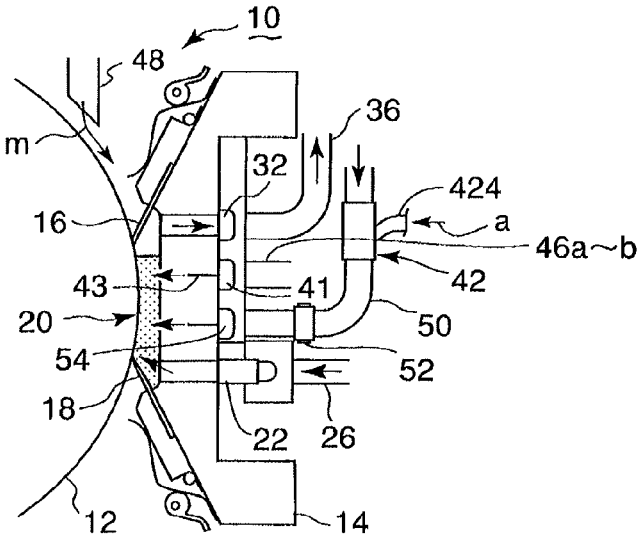
FIG. 7 is a side cross-sectional view schematically illustrating the flexographic printing machine of the second embodiment.

In FIGS. 6 and 7, a cleaning water supply port 54 is formed in an ink chamber 20, and a cleaning water supply pipe 50 is connected to the cleaning water supply port 54. An air gun 42 and a solenoid valve 52 are interposed in the cleaning water supply pipe 50. Furthermore, an air gun 56 is interposed in the ink recovery pipe 36, in place of the ink recovery pump 38 of the first embodiment. Other structures are same as those in the first embodiment. The air gun 56 has the same structure as that of the air gun 42 shown in FIG. 3.

The procedure for changing inks in the flexographic printing machine 10 of this embodiment in this structure will be described with reference to FIGS. 8 (*a*) to 8 (*f*). FIG. 8(*a*) illustrates a printing operation with a previous order ink. The ink supply pump 28 is operated to supply the previous order ink "f" from the ink supply pipe 26 into the ink chamber 20, via the ink supply port 22.

Figures 8A, 8B, 8C, 8D, 8E, 8F:
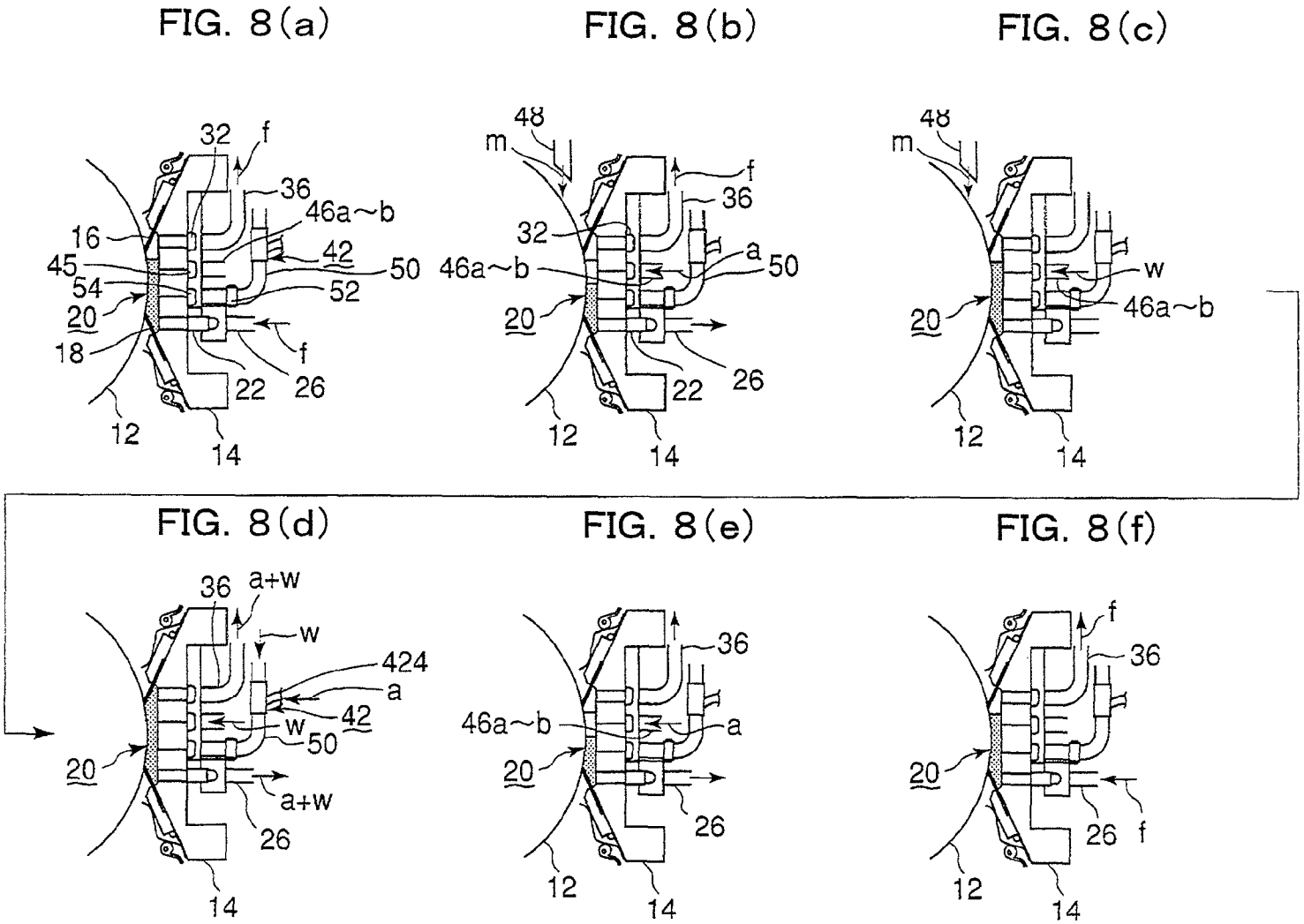
FIGS. 8 (*a*) to 8 (*f*) are side cross-sectional views schematically illustrating an ink change procedure of the second embodiment.

For changing inks, firstly, as shown in FIG. 8(*b*), dampening water "m" is supplied from the pipe 48 to the anilox roll 12, as well as supplying compressed air "a" from the pipes 46*a-b* into the ink chamber 20. The supplied compressed air "a" pressurizes inside the ink chamber 20, and the ink "f" in the ink chamber 20 is drained from the ink supply pipe 26 and the ink recovery pipe 36 to the ink can 30.

In this step, the ink can be quickly collected, by rotating the ink supply pump 28 in the direction reverse to the rotation direction during the ink supply, and by supplying compressed air "a" to the compressed air supply pipe 561 connected to the air gun 56 to suction the ink "f" toward the ink can 30.

Subsequently, the ink can 30 is replaced with the waste fluid pit (not shown). Subsequently, as shown in FIG. 8(*c*), cleaning water "w" is supplied from the pipes 46*a-b* into the ink chamber 20 to fill the chamber 20 with the cleaning water "w".

Subsequently, as shown in FIG. 8(*d*), by supplying cleaning water "w" to the cleaning water supply pipe 50, and by supplying compressed air "a" to the compressed air supply pipe 424 of the air gun 42, the compressed air "a" is mixed into the cleaning water "w", as well as jetting the bubble-containing cleaning water (a+w) into the ink chamber 20 by means of the suctioning action of the compressed air "a". By jetting the bubble-containing cleaning water (a+w) into the ink chamber 20, the outer peripheral face of the anilox roll 12 and the inside of the ink chamber 20 are cleaned by means of the agitating action of the bubbles and a high velocity flow generated by the air gun 42. This cleaning step is continued for a predetermined time duration.

After the cleaning step is completed, as shown in FIG. 8(*e*), compressed air "a" is supplied to the pipes 46*a-b* to recover the cleaning water "w" in the ink chamber 20, through the ink supply pipe 26 and the ink recovery pipe 36, into the waste fluid pit. In this step, by rotating the ink supply pump 28 in the reverse direction and operating the air gun 56, the recovery time of the cleaning water "w" can be reduced.

After collecting the cleaning water "w", the waste fluid pit is replaced with an ink can 30 for a subsequent order, and as shown in FIG. 8(*f*), a subsequent order ink is supplied to the ink chamber 20 through the ink supply pipe 26, for performing printing of the subsequent order.

In accordance with this embodiment, by supplying bubble-containing water "w" to the ink chamber 20 during ink cleaning, the cleaning effect on the inside of the ink chamber 20 can be improved by means of the agitating action of the bubbles and a high velocity flow generated by the air gun 42. Accordingly, the cleaning time can be reduced, as well as reducing the consumption of the cleaning water "w".

Furthermore, during ink recovery and recovery of cleaning water, the ink recovery time and the recover time for cleaning water can be reduced by rotating the ink supply pump 28 in the reverse direction, as well as operating the air gun 56. Thus, the total time required for ink cleaning or ink change can be significantly reduced. As a result, the production efficiency of a box producing apparatus can be improved.

In the first and second embodiments, the cleaning and ink change steps in the flexographic printing machine 10 can be automated by providing a controller for controlling the solenoid valves, pumps, and the air guns; storing, in the controller, historical operation data of a box producing apparatus line and a flexographic printing machines 10; and providing a learning function or a function to select among operation modes.

Furthermore, as illustrated with two-dot chain line in FIG. 1, in the system of the present invention, a control panel that displays a pressure ratio or a flow rate ratio between each fluid contained in the multiphase fluid may be provided. This allows the operator to appropriately control the pressure ratio or the flow rate ratio between each fluid contained in the multiphase fluid, while watching the control panel, to improve the cleaning effect on the inside of the ink chamber. The control panel provided to the flexographic printing machine facilitates control of the pressure ratio or the flow rate ratio between each fluid contained in the multiphase fluid.

Third Embodiment

Figure 9:
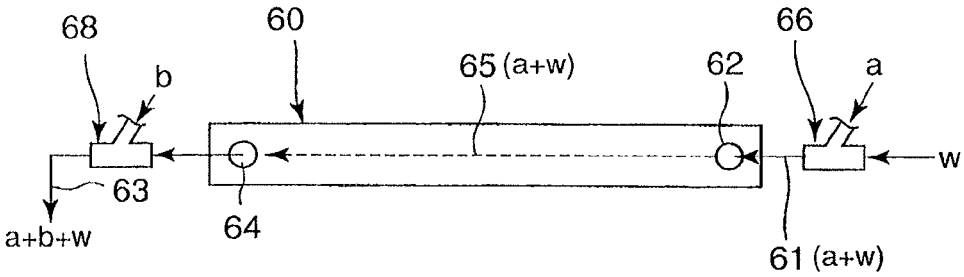
FIG. 9 is a schematic diagram illustrating a third embodiment of a method and a system of the present invention.
Figure 10A:
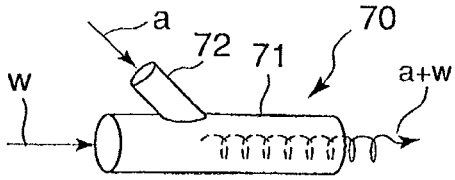
FIGS. 10 (*a*) to 10 (*e*) are illustrative diagrams illustrating various exemplary configurations of bubble generators used in the method and the system of the present invention.
Figure 10B:
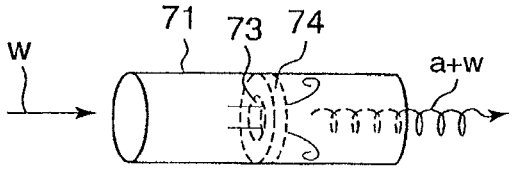
Figure 10C:
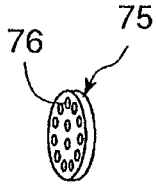
Figure 10D:
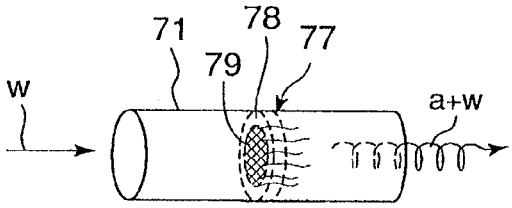
Figure 10E:
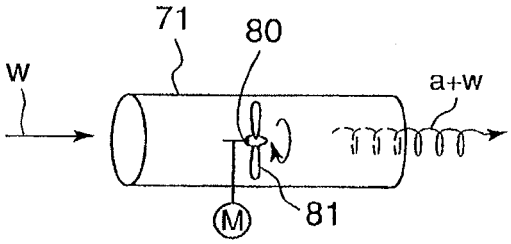
Figure 11:
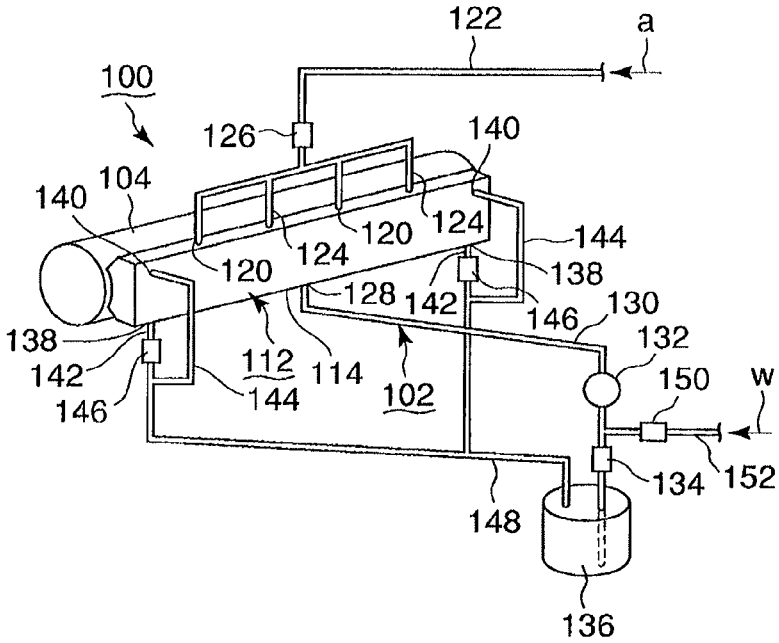
FIG. 11 is a perspective view schematically illustrating a conventional system for cleaning off an ink in a flexographic printing machine.
Figure 12:
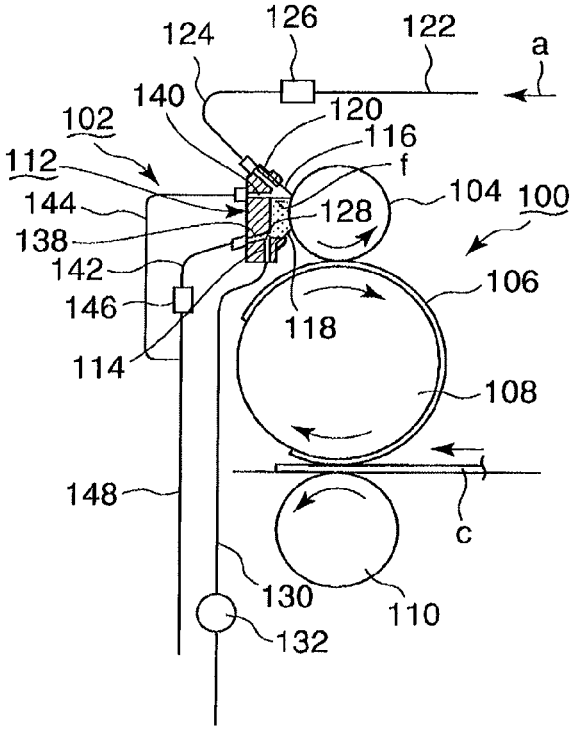
FIG. 12 is a side cross-sectional view schematically illustrating the system for cleaning off an ink in the flexographic printing machine in FIG. 11.

Next, a third embodiment of a method and a system of the present invention will be described with reference to FIG. 9. FIG. 9 is a schematic diagram of an ink chamber 60 viewed from the front, and components, such as an anilox roll 12, are omitted from the illustration. In FIG. 9, a cleaning water supply port 62 is provided at one end of the ink chamber 60, and a cleaning water drain port 64 is provided at the other end of the ink chamber 60. A cleaning water supply pipe 61 is connected to the cleaning water supply port 62, and a cleaning water drain pipe 63 is connected to the cleaning water supply port 62. An air gun 66 is interposed in the cleaning water supply port 62, and an air gun 68 is interposed in the cleaning water drain port 64.

For cleaning off an ink in the ink chamber 60, compressed air "a" is supplied to the air gun 66, thereby suctioning cleaning water "w" by means of the suction force of the compressed air "a". The cleaning water (a+w), containing the air and the cleaning water mixed together, is supplied into the ink chamber 60, from the cleaning water supply port 62. A one-directional flow (a+w) 65 of the mixed cleaning water (a+w), flowing from the cleaning water supply port 62 toward the cleaning water drain port 64, is generated in the ink chamber 60. The mixed cleaning water (a+w) flows to reach the cleaning water drain port 64, while cleaning off the ink "f" in the ink chamber 60. The mixed liquid of the mixed cleaning water (a+w) and the ink "f" reaching the cleaning water drain port 64 is drained from the cleaning water drain port 64 into the cleaning water drain pipe 63.

Compressed air "b" supplied to the air gun 66 interposed in the cleaning water drain pipe 63 provides an ejection action, which causes the mixed liquid in the ink chamber 60 to be ejected into the cleaning water drain pipe 63. In this manner, the mixed liquid, which is the mixture of the compressed air (a+b) and the cleaning water "w", and the ink "f" cleaned off from the ink chamber 60, is drained to the cleaning water drain pipe 63 downstream to the air gun 68.

In accordance with this embodiment, by means of the combined effect of the suctioning action by the air gun 66 disposed upstream to the ink chamber 60 and the ejection action by the air gun 68 disposed downstream to the ink chamber 60, the pressure gradient inside the ink chamber 60 can be increased. As a result, a high velocity one-directional flow 65 of the mixed cleaning water (a+w) can be generated in the ink chamber 60. By generating such a one-directional flow 65, the ink cleaning effect on the inside of the ink chamber 60 can be improved. Furthermore, by generating a high velocity one-directional flow 65 in the ink chamber 60, the efficiency of the cleaning can be improved.

Forth Embodiment

Next, a forth embodiment of a method and a system of the present invention will be described with reference to FIG. 10. This embodiment supplies bubble-containing cleaning water to an ink chamber by providing a bubble generator at a passage for supplying cleaning water "w" to the ink chamber. FIGS. 10 (*a*) to 10 (*e*) show various exemplary configurations of bubble generators.

FIG. 10(*a*) shows a generator 70 including a cleaning water supply pipe 71 and an air supply pipe 72 connected to the cleaning water supply pipe 71, diagonally towards the direction of the flow of cleaning water "w". This generator 70 can take the air "a, from the outside, through the air supply pipe 72 by means of the ejector action which directs the cleaning water "w" to the cleaning water supply pipe 71 to the ink chamber. This configuration can generate dual-phase mixed flow (a+w) containing bubbles, which is supplied to the ink chamber. Furthermore, the structure can be simplified, which helps to reduce the cost.

FIG. 10(*b*) shows a disk-shaped contraction flow plate 74 having an orifice 73 at the center, within a cleaning water supply pipe 71. When cleaning water "w" passes through the contraction flow plate 74, the flow is contracted by the orifice 73, which increases the flow velocity. This includes a pressure drop, which results in generation of bubbles by the cavitation action. By supplying the bubble-containing cleaning water to the ink chamber 20, the cleaning effect on the ink chamber can be improved by the agitating action resulted from collapse of the bubbles.

By providing a porous plate 75 having multiple pores 76 formed therein, in place of the contraction flow plate 74, a pressure drop can also be induced to generate bubbles, as shown in FIG. 10(*c*).

FIG. 10(*d*) is an example in which a contraction flow plate 77 having mesh pores 79 formed therein, in a ring body 78 defining an orifice, is provided at the passage in a cleaning water supply pipe 71. By providing the contraction flow plate 77, bubbles are generated due to a pressure drop resulted from the orifice effect. In addition, the turbulent flow is generated when dual-phase mixed flow (a+w) passes through the mesh pores 79. As a result, dual-phase mixed flow (a+w) exhibiting a higher cleaning effect, containing evenly distributed bubbles, is formed.

FIG. 10(*e*) is an example in which an axial flow pump 80 is provided within a cleaning water supply pipe 71. By rotating a fan 81 of the axial flow pump 80, a cavitation action is induced on the surface of the fan to generate bubbles. This example is advantageous in that bubbles can be gene rated without inducing any undesirable pressure loss in the cleaning water supply pipe 71.

By providing any of various bubble generators at a piping line for supplying cleaning water to an ink chamber, the cleaning effect can be improved.

INDUSTRIAL APPLICABILITY

In accordance with the present invention, change of inks, including a cleaning step, can be performed in a shorter time, in a flexographic printing machine provided to a box producing apparatus. Thus, the production efficiency of the box producing apparatus can be improved, as well as improving the cleaning effect of an ink chamber and reducing the consumption of cleaning water.

What is claimed is:

1. A method of cleaning off an ink in a flexographic printing machine, wherein a flexographic ink is supplied to an ink chamber facing an outer peripheral face of an anilox roll, and the flexographic ink is transferred from the anilox roll to a printing die wound about a printing cylinder, the method comprising:

after removing the flexographic ink from the ink chamber, supplying a multiphase fluid to the ink chamber by a multiphase fluid generator, to generate a pressure difference between two ends of the ink chamber in a longitudinal direction of the ink chamber by means of a discharging action of the multiphase fluid generator, the pressure difference generating a one-directional flow of the multiphase fluid in the longitudinal direction of the ink chamber, to clean the ink chamber by means of a cleaning action of the multiphase fluid, the multiphase fluid containing a gas or minute granular solids in two or more liquids or a liquid;

wherein first air is supplied into the multiphase fluid by the multiphase fluid generator before the multiphase fluid is supplied to the ink chamber, and second air is supplied into the multiphase fluid discharged from the ink chamber by a pressure difference generating device to generate the pressure difference between the two ends of the ink chamber in the longitudinal direction of the ink chamber.

2. The method of cleaning off an ink in a flexographic printing machine according to claim 1, further comprising connecting a circulation line for the multiphase fluid to the ink chamber to supply the multiphase fluid to the ink chamber through the circulation line in a circulatory manner.

3. The method of cleaning off an ink in a flexographic printing machine according to claim 1, further comprising controlling a pressure ratio or a flow rate ratio between each fluid contained in the multiphase fluid to improve a cleaning effect on an inside of the ink chamber.

4. The method of cleaning off an ink in a flexographic printing machine according to claim 2, further comprising controlling a pressure ratio or a flow rate ratio between each fluid contained in the multiphase fluid to improve a cleaning effect on an inside of the ink chamber.

5. A system for cleaning off an ink in a flexographic printing machine, wherein a flexographic ink is supplied to an ink chamber facing an outer peripheral face of an anilox roll, and the flexographic ink is transferred from the anilox roll to a printing die wound about a printing cylinder, the system comprising:

a multiphase fluid supply path that supplies a multiphase fluid to an ink chamber;

a multiphase fluid drain path that drains the multiphase fluid out of the ink chamber; and a multiphase fluid generator that supplies the multiphase fluid to the multiphase fluid supply path; and a first air gun formed on the multiphase fluid supply path and a second air gun formed on the multiphase fluid drain path, wherein the system is configured to generate a pressure difference between two ends of the ink chamber in a longitudinal direction of the ink chamber by means of a discharging action of the multiphase fluid generator that supplies the multiphase fluid, the pressure difference generating a one-directional flow of the multiphase fluid in the longitudinal direction of the ink chamber, to clean an inside of the ink chamber by means of a cleaning action of the multiphase fluid; and the ink chamber includes a supply port formed on one end portion thereof, and a drain port formed on another end portion thereof, the first air gun is arranged before the supply port to supply first air into the multiphase fluid flowing toward the supply port, and the second air gun is arranged after the drain port to supply second air into the multiphase fluid discharged from the drain port.

6. The system for cleaning off an ink in a flexographic printing machine according to claim 5, further comprising a supply circulatory passage which connects the multiphase fluid supply path and the multiphase fluid drain path, for supply the multiphase fluid to the ink chamber in a circulatory manner.

7. The system for cleaning off an ink in a flexographic printing machine according to claim 5, wherein the multiphase fluid is a cleaning liquid containing bubbles, and the multiphase fluid generator generates the cleaning liquid containing the bubbles at the multiphase fluid supply path by supplying air to the cleaning liquid flowing through the multiphase fluid supply path.

8. The system for cleaning off an ink in a flexographic printing machine according to claim 6, wherein the multiphase fluid is a cleaning liquid containing bubbles, and the multiphase fluid generator generates the cleaning liquid containing the bubbles at the multiphase fluid supply path by supplying air to the cleaning liquid flowing through the multiphase fluid supply path.

9. The system for cleaning off an ink in a flexographic printing machine according to claim 5, further comprising a control panel that displays a pressure ratio or a flow rate ratio between each fluid contained in the multiphase fluid.

10. The system for cleaning off an ink in a flexographic printing machine according to claim 6, further comprising a control panel that displays a pressure ratio or a flow rate ratio between each fluid contained in the multiphase fluid.

11. The method of cleaning off an ink in a flexographic printing machine according to claim 1, further comprising circulating the multiphase fluid from the pressure difference generating device to the multiphase fluid generator after supplying the second air into the multiphase fluid.

12. The system for cleaning off an ink in a flexographic printing machine according to claim 5, further comprising a circulation line connecting between the multiphase fluid supply path and the multiphase fluid drain path, wherein the multiphase fluid is circulated from the drain port to the supply port though the circulation line.

* * * * *